US007255166B1

(12) United States Patent
Weiss

(10) Patent No.: US 7,255,166 B1
(45) Date of Patent: Aug. 14, 2007

(54) IMBIBITION WELL STIMULATION VIA NEURAL NETWORK DESIGN

(76) Inventor: William Weiss, P.O. Box 730, Socorro, NM (US) 87801

( * ) Notice: Subject to any disclaimer, the term of this patent is extended or adjusted under 35 U.S.C. 154(b) by 354 days.

(21) Appl. No.: 10/901,865

(22) Filed: Jul. 28, 2004

(51) Int. Cl.
*E21B 47/00* (2006.01)
*G06F 19/00* (2006.01)

(52) U.S. Cl. ..... 166/250.02; 166/250.01; 702/13; 706/929

(58) Field of Classification Search ..... 166/250.02, 166/250.15, 250.1; 702/12–13; 706/929
See application file for complete search history.

(56) References Cited

U.S. PATENT DOCUMENTS

| | | | |
|---|---|---|---|
| 2,792,894 | A | 5/1957 | Graham et al. |
| 3,498,378 | A | 3/1970 | Stone et al. |
| 6,002,985 | A | 12/1999 | Stephenson |
| 6,236,894 | B1 | 5/2001 | Stoisits et al. |
| 6,574,565 | B1 | 6/2003 | Bush |
| 2001/0037178 | A1 | 11/2001 | Bush |
| 2002/0138241 | A1 | 9/2002 | Storm, Jr. et al. |

FOREIGN PATENT DOCUMENTS

| | | | |
|---|---|---|---|
| EP | 0 881 357 | A2 | 2/1998 |
| WO | WO 99/60247 | A1 | 11/1999 |
| WO | WO 03/052669 | A1 | 6/2003 |

OTHER PUBLICATIONS

Standnes, D.C., et al., "Wettability Alteration in Low-Permeability Chalk. Mechanism for Wettability Alteration from Oil-Wet to Water-Wet Using Surfactants", 6th Int'l Sympos. on Reservoir Wettability and its Effect on Oil Recovery Socorro, NM Sep. 27-28, 2000.

Chawathe, A. et al. "One Core, Few Modem Logs, and Limited Production Data: Is Reliable Reservoir Characterization Possible?", SPE Paper 38260,67th Annual SPE Western Regional Meeting, Longbeach CA, Jun. 25-27, 1997.

Ouenes, A., "Fractures Reservoir Characterization and Performance Forecasting Using Geomechanics and Artificial Intelligence,", SPE Paper 30572, SPE Annual Technical Conference and Exhibition, Dallas, TX, Oct. 22-25, 1995.

Klefors, D., "Artificial Neural Networks", Saint Louis University website <http://hem.hj.se>, 1998.

Weiss, W. et al., "Integrating Core Porosity and Sw Measurements with Log Values," SPE Paper 55642, SPE Rocky Mountain Regional Meeting, Gillette, Gillette, Wyoming, May 15-18, 1999.

Du, Y. et al., "Obtain an Optimum Artificial Neural Network Model for Reservoir Studies," SPE Paper 84445, SPE Annual Technical Conference and Exhibition; Denver, CO, Oct. 5-8, 2003.

Willingham, R. W., "The Influence of Geologic Heterogeneities on Secondary Recovery from the Permian Phosphoria REservoir: Cottonwood Creek, Wyoming", SPE Paper 1770.

*Primary Examiner*—David Bagnell
*Assistant Examiner*—G M Collins
(74) *Attorney, Agent, or Firm*—Fain IP Law, P.C.; Katy C. Fain

(57) ABSTRACT

A method for stimulation of hydrocarbon production via imbibition by utilization of surfactants. The method includes use of fuzzy logic and neural network architecture constructs to determine surfactant use.

20 Claims, 13 Drawing Sheets

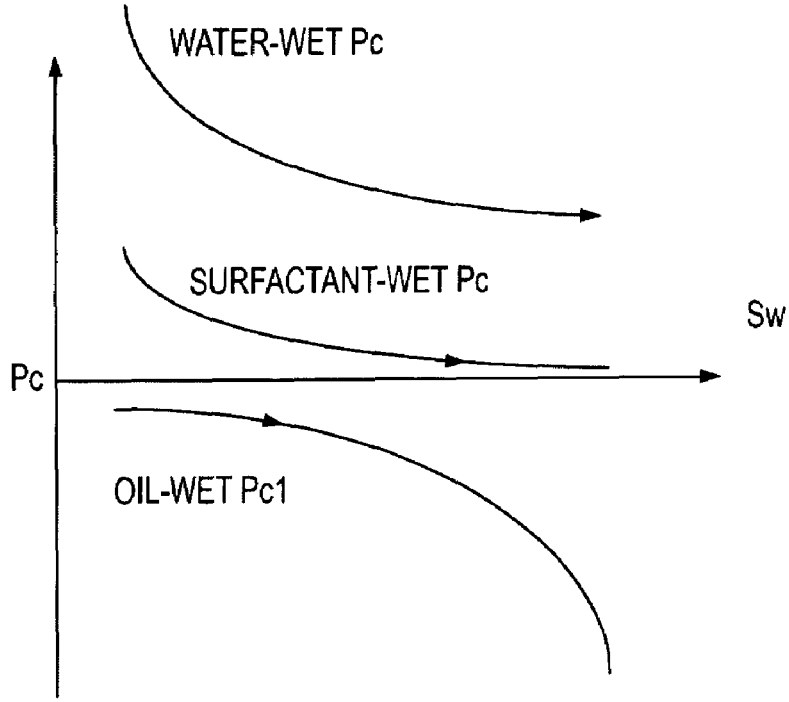
FIG.1
FIG.2a
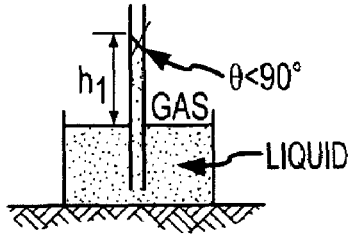
FIG.2b
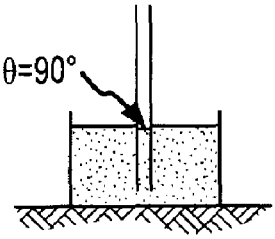
FIG.2c
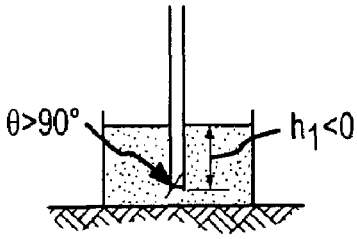

IMBIBITION WELL STIMULATION VIA NEURAL NETWORK DESIGN

GOVERNMENT RIGHTS

The United States government has a paid up license in this invention and the right in limited circumstances to require the patent owner to license to others on reasonable terms as provided for by the term of Contract No. DE-FG-03-01ER83226/A001 awarded by the Department of Energy.

COPYRIGHTED MATERIAL

A portion of the disclosure of this document contains or makes reference to copyrighted material that is subject to copyright protection. The owner has no objection to the facsimile reproduction by anyone of the patent document or the patent disclosure as it appears in the United States Patent and Trademark Office patent file or records, but otherwise reserves all copyrights whatsoever.

BACKGROUND OF THE INVENTION

1. Field of the Invention

The present invention pertains generally to stimulation of hydrocarbon production. The present invention is a method for altering the wettability of reservoir rock and reducing the interfacial tension between water and hydrocarbon in a more efficient manner than prior art methods. Most particularly, the method of the invention achieves that efficiency by optimizing the amount of surfactant required for successful well treatments by utilizing fuzzy logic and neural networks.

2. Prior Art

This invention pertains to increasing the underground reservoir production rate of hydrocarbons in the state of fluids or gas by altering the wettability of the hydrocarbon bearing rock surface. Underground reservoirs inherently consist of porous and permeable rocks that contain oil, gas and water (and other minerals and contaminants not dealt with here for simplicity but well-known in the art). Upon discovery of a well, the pressure in the porous rock matrix typically exceeds that in the borehole or fractures connecting the matrix to the borehole, and gas and/or fluids can be withdrawn from the reservoir. A helpful example of the underground system is shown in U.S. Pat. No. 2,792,894 to Graham et al. As the pressure between the matrix and the borehole equilibrates, the importance of the wettability of the matrix surface increases.

This importance of wettability is demonstrated in the difference in the capillary pressure for water wet and oil wet surfaces. As shown theoretically in FIG. 1, at a 20% water saturation, the difference between the capillary pressure of oil wet and water wet surfaces is greater than 100 psi. This is particularly significant when the reservoir pressure is low. (Capillary pressure is a force that governs the distribution of oil, gas, and water throughout the reservoir and its importance is described in detail in the 1970 patent to Stone et al., U.S. Pat. No. 3,498,378, and is well-known in the art.) Thus, as shown in FIG. 1, changing the wettability of the surface will result in promotion of countercurrent imbibition, thereby generating the water wet curve. In countercurrent imbibition, water is imbibed into the rock dispelling oil in a "countercurrent" expulsion, allowing the oil to be recovered at the wellbore through a fracture. This process can be further improved by use of surface active agents (i.e., surfactants) which reduce interfacial surface tension between the oil and water phase and alter the contact angle of the fluid that wets the rock surface.

The demonstrative capillary pressure curves of FIG. 1 were generated by altering only the contact angle, θ, in the capillary pressure equation wherein capillary pressure, $$P_c = \frac{2\sigma\cos\theta}{r}$$

wherein

θ is the contact angle,

σ is the interfacial tension, and r is the radius of a tube or bundle of tubes (described by the ratio of the square root permeability to porosity of porous rock).

Contact angles are generally defined in FIG. 2 for a gas-liquid-solid capillary tube system. When the contact angle is less than 90° the tube surface is water wet; when the contact angle is equal to 90° the surface displays intermediate wettability; and when the contact angle is greater than 90° the surface is oil wet.

The system shown in FIG. 3 is water-oil-solid. When the contact angle measured through water of the oil drop is less than 90° the surface is water wet and when the contact angle is greater than 90° the surface is oil wet.

The effect of altering the wettability of an oil wet system with various chemicals is discussed in U.S. Pat. No. 2,792,894 to Graham et al., and is well-known in the art. Graham et al. described non-ionic, anionic, and cationic surfactants. U.S. Pat. No. 4,842,065 to McClure also describes surfactant use, but improves on the '894 patent by describing a laboratory procedure that is somewhat different than the laboratory procedure described in the earlier patent. The '065 patent also specifically requires that injection wells be used to employ the process. Therefore, it is well-known in the art that surfactants may be employed to increase wettability of the rock surface to recover additional oil. However, it is also known in the art that different surfactants and surfactant amounts produce differing results that vary from formation-to-formation, field-to-field, and sometimes well to well.

This was shown when D. C. Standnes and T. Austad presented a laboratory method to evaluate the effect of surfactants on oil recovery via spontaneous imbibition. Standnes, D. C. and Austad, T.: "*Wettability Alteration in Low-Permeability Chalk. Mechanism for Wettability Alteration from Oil-Wet to Water-Wet Using Surfactants,*" 6$^{th}$ International Symposium on Reservoir Wettability and its Effect on Oil Recovery, Socorro, N. Mex., 27-28 Sep. 2000. Our FIG. 4 generally depicts this method, showing an imbibition cell wherein a reservoir core saturated with reservoir oil is placed in reservoir water within the cell. The system is then allowed to equilibrate at reservoir temperature. Depending on the wettability of the core surface, the water in the imbibition cell may imbibe into the core and displace oil. The amount of oil recovered is then measured in the graduated cylinder of the imbibition cell. Once water imbibition stabilizes, surfactant is added to the system to alter the wettability and produce additional oil for recovery. A successful surfactant experiment (oil recovery versus time) is shown in FIG. 5. The "recovery vs. time" curves shown reach a plateau (equilibration of the system) until a solution of 500 ppm of a cationic surfactant replaces the reservoir water (increasing wettability) and oil recovery resumes. Conversely, FIG. 6 shows the results of a nonproductive surfactant addition oil recovery experiment. This demonstrates that laboratory tests are useful for selecting surfactants for field applications, given the variability of reservoir fluid systems. Similar imbibition results for a gas-water-core system are shown in FIG. 7, which can be viewed in the context of FIG. 2. The core titled "untreated" (water-wet) imbibed much more water than the cores that were made less water wet as they were "treated" with surfactant.

However, up-scaling the laboratory results to field applications currently remains difficult because of the large number of variables involved in field tests. Laboratory experiments are conducted under controlled conditions where the variables such as (but not limited to) volume, core porosity, permeability, surface area, and saturations are precisely measured. Because some field test variables are based only or partially on indirect measurements obtained from logs, these variables are usually not precise. Instead, they are "fuzzy". As a result of these imprecise variables, the present invention, as disclosed herein, is particularly useful in its use of artificial intelligence, comprising application of fuzzy logic and use of neural networks, to analyze such data.

Fuzzy logic, used as a ranking tool for neural network inputs, is a powerful new analytical tool. Fuzzy logic was first applied to core dataset, by Chawathe, Ouenes, Ali, and Weiss (named inventor herein), and later defined as a ranking tool for neural network inputs by them, as informationally depicted here in FIGS. 8, 9 & 10, and explained herein. Chawathe, A., Ouenes, A., Ali, M., and Weiss, W. W.: "*One Core, Few Modern Logs, and Limited Production Data: Is Reliable Reservoir Characterization Possible?*" *SPE Paper* 38260, 67$^{th}$ Annual SPE Western Regional Meeting, Long Beach Calif., 25-27 Jun. 1997.

In understanding the principles for application of fuzzy logic consider a dataset consisting of two variables x and y, where y is the random value of x or $y_i$=random ($x_i$) (by definition the dataset is 100% noise). For each data ($x_i$, $y_i$), a "fuzzy membership function" is defined using the following relationship:

Fuzzy Membership Function, $$F_i(x) = \exp\left(-\left(\frac{x_i - x}{b}\right)^2\right) \cdot y_i,$$

Wherein:
x=input variable
i=1, 2, 3 . . . N
N=Total number of input pairs
$y_i$=random ($x_i$) or desired output variable; and $$b = \frac{(x_{\max} - x_{\min})}{\sqrt{i}}$$

A fuzzy membership function was generated for each of the 100 random data points as shown in FIG. 8. The two bell shaped curves shown in the crossplot of a distribution curve of 100 random data points are shown in FIG. 8 and were generated with a fuzzy membership function.

As shown in FIG. 9, the same fuzzy membership function is applied to a 100 point dataset with an $x^{0.5}$ trend added. The fuzzy membership value is calculated for each output variable y using all the available input data. These values are iteratively summed to obtain the fuzzified values of the input dataset with respect to each of the desired output y. These values are then defuzzified to generate the fuzzy curve as depicted in FIG. 10, by using the fuzzy curve function, $$FC(x) = \frac{\sum_{i=1}^{N} F_i(x)}{\sum_{i=1}^{N} F_i(x)/y_i}$$

Wherein:
$F_i$(x) is the fuzzy membership function for each input x;
i=1, 2, . . . N
N=Total number of input pairs
$y_i$=random ($x_i$).

The final curve can be interpreted for the utility of given inputs for linear or non-linear regressions.

The fuzzy curve generated with the 100% noisy (random) dataset as shown in FIG. 10 exhibits no correlation between x and y and therefore would not be considered as a reliable neural network input variable. The fuzzy curve generated with the noisy dataset that included a square root of x trend, FIG. 10, showed that as x increases, so did the fuzzyfied y value. Hence, fuzzy logic can differentiate between datasets that exhibit a relationship between variables from those that have no relationship. The difference between the maximum and minimum values of the fuzzyfied variable y, also called the "range," is an indicator of the strength of the relationship between the two variables. The "goodness" of the fuzzy curve can be estimated by adding the value of "least square fit" correlation coefficient to the value of the fuzzy curve range. The sum of the range and the correlation coefficient of the straight line is called "goodness" For example in the FIG. 10 the range of the fuzzy curve with the added trend is 0.9 and the correlation coefficient of the best fit line to the fuzzy curve data points is about 0.9 and the "goodness" is 1.8. Conversely, the fuzzy curve generated with random data has a range of about 0.2 and least square fit line correlation coefficient of about 0.9 or the goodness is 1.1—much less than the trend data. Hence fuzzy curves can differentiate between random data and correlatable data.

Returning to the non-theoretical, typically datasets for field experiments are complex, especially field experiments containing many variables. Further complicating the experiment is the problem that some of the variables may have no bearing on the measured result. In fact, seldom is a correlation between the result and any one variable satisfactory. As a result, it is necessary to determine what variables are correlated to the desired result and how much weight to give to each particular variable. Based on the deviation of the variable on the fuzzy curve from a flat curve, each attribute is assigned a rank, which allows a direct estimation of which attributes would contribute the most to a particular regression. The ranking value is used to prioritize neural network input variables as described further herein.

Neural networks are particularly well-suited for correlating multiple variables with experimental results. This makes them particularly useful for the multiple variables potentially associated with field experiments. However, care must be exercised to avoid neural net inputs (experimental variables) that do not influence the neural network output (result) in the design of the neural network architecture (also known as topology), as noted by Ouenes, Richardson, and Weiss. Ouenes, A., Richardson, S., Weiss, W. W.: "*Fractured reservoir Characterization and Performance Forecasting*

*Using Geomechanics and Artificial Intelligence," SPE Paper* 30572, SPE Annual Technical Conference and Exhibition held in Dallas Tex., 22-25 Oct. 1995.

A brief explanation of neural network terminology, operation, and design may be helpful. Artificial neural networks are systems loosely modeled on the human brain. They are an attempt to simulate within hardware and/or software, the multiple layers of simple processing elements called neurons. Each neuron is linked to all of its neighbors with varying coefficients of connectivity (weights) representing the strengths of each of the connections in the forward direction. Adjusting strengths to cause the overall network to output appropriate results accomplishes "learning" or "training" of the system. In equations, various "inputs" to the network are typically represented by the mathematical symbol, x(n). Each of these inputs are multiplied by a "connection weight" or "weight", these weights are represented by w(n). In the simplest neural network architecture, these products are simply summed, fed through a transfer function to generate a result, and then output is determined. In neural network design, the designer typically utilizes trial and error in the design decisions.

The design issues in neural networks are complex, so it is understood for the purposes of this disclosure that someone familiar with the art would also be familiar with neural network design. Designing a neural network comprises: arranging neurons in various layers, deciding the type of connections among neurons for different layers, as well as among the neurons within a layer, deciding the way a neuron receives input and produces output, and determining the strength of connection within the network by allowing the network to learn the appropriate values of connection weights by using a training data set.

Artificial neural networks are the simple clustering of the primitive artificial neurons (which are not capable of the interconnections of natural neurons). Instead, simple clustering is utilized by creating interconnected layers. Basically, all artificial neural networks have a similar structure of topology. Some of the neurons (input layer) interface outside of the neural network to receive inputs while other neurons (output layer) provide the network's outputs. All other network neurons are "hidden" from view (hidden layer). When the input layer receives input, its neurons produce output, which then, in turn, becomes input to the other layers of the system. The process continues until a certain condition is satisfied or until the output layer is invoked. An important problem in neural network design is determining the number of hidden neurons best used in the network. If the hidden number of neurons is increased too much, overtraining will result in the network being unable to "generalize". The training set of data will be memorized, making the network effectively useless on new data sets. Daniel Klerfors, "*Artificial Neural Networks*", Saint Louis University website, <http://hem.hj.se>, 1998.

Neural network architecture defines the number of input nodes, the number of hidden layers, the number of nodes in a hidden layer, and the number of nodes in the output layer. For example, a 3-3-1 neural network contains an input layer with 3 nodes (one for each variable), a hidden layer with 3 nodes and an output layer with a single node. The complexity of the architecture is limited by the size of the available dataset hence the architecture would depend on the depend on the dataset being used. Typically feedforward-backpropagation neural networks are preferred with the architecture defined by the number of output values available. Generally the number of output values should exceed the number of weights (sum of all tie lines between nodes in adjacent layers) by a factor of two. The number of output values would generally not be large in oilfield datasets, not exceeding a few hundred and frequently less than 30. If the number of output values is 50 the desired number of weights is less that 25 or if there are three input nodes and one output node the architecture could consist of one hidden layer of six nodes for a total of 24 weights. Occasionally two hidden layers provide better training results, in which case the number of nodes should be limited to three per hidden layer, for a total of 21 weights.

The input variables for neural network applications described herein typically are production values such as barrels of oil, water, or gas. Key input values are controlled changes in the well conditions—such as the amount and volume of chemicals used to stimulate the well. Petrophysical variables are also used (and those measured by electronic logs are particularly useful). These variables consist of gamma ray, neutron, density, resistivity, and other measurements obtained from electronic log across the producing formation. The output values are the result of changing controlled well conditions. The results are generally expressed as the change in the oil, gas, and water producing rates either as absolute values or percentages of the change.

Seismic refelection information such as amplitude and frequency and their derivatives frequently serve as input variables when applying neural networks to exploration problems. Output variables are parameters that characterize the formation such as porosity, saturations, and lithology.

Neural networks are used to solve inverse problems where the answer is known (the outputs). No single variable correlates with the answer in a satisfactory manner, but multiple variables enhance the correlation. Neural networks solve these inverse problems by generating the appropriate constants (weights). A generalized matrix solution for one iteration through a neural network between any two layers in the network is given by the following equation:

$$\text{Out1}=\text{Act}*[W*\text{In}]$$

Wherein:

$$W=\left[\begin{array}{cc|c} W_{11} & W_{12} & W_{1i} \\ W_{21} & W_{22} & W_{2i} \\ \hline W_{k1} & W_{k2} & W_{ki} \end{array}\right] \text{ is the weight matrix}$$

$$In=\left[\begin{array}{c} In_1 \\ In_2 \\ \hline In_i \end{array}\right] \text{ is the matrix of the input variables}$$

$$Out1=\left[\begin{array}{c} Out1_1 \\ Out1_2 \\ \hline Out1_k \end{array}\right] \text{ is the output matrix at each layer}$$

$$Act=\left[\begin{array}{cc|c} f_{11} & 0 & 0 \\ 0 & f_{22} & 0 \\ \hline 0 & 0 & f_{ki} \end{array}\right] \text{ is a nonlinear diagonal activation function matrix}$$

i=Total number of inputs to a given layer k=Total number of nodes in a given hidden/output layer $W_{ki}$=is the weight that connects the output of the $i^{th}$ input node to the input of the $k^{th}$ hidden node Applying this matrix multiplication to a simple 2-2-1 neural network the following regression equation is obtained:

$$\text{Out1}=f(v_1*f(w_1*\text{in1}+w_3*\text{in2})+v_2*f(w_2*\text{in1}+w_4*\text{in2}))$$

Wherein in1, in2=input variables;

Out1=the output/result;

$w_i$, $v_i$=constants for weighting input variables for each layer i=1, 2, . . . N N=Total number of weights connecting any two layers in1 and in2 are two variables (inputs) that are believed to strongly influence the result termed Out1 ("output" in neural net parlance). For example, feedforward backpropagation neural networks (as known in the art) solve the regression equation by changing the weights, $w_i$, and solving the equation until the output approximates the experimental result. Once a suitable equation is generated, the neural network can be used to forecast a result given a set of the input variables by simply feeding the inputs through the equation.

It is very important that the variables selected as neural network inputs bear a relationship to the output in order to avoid a problem known in the art as "overtraining". Training neural networks is a notoriously difficult problem. It is analogous to the concept of curve fitting for rule-based systems. A good explanation of overtraining as described by Weiss, W. W et al: "*Integrating Core Porosity and Sw Measurements with Log Values,*" *SPE Paper* 55642, SPE Rocky Mountain Regional Meeting; Gillette, Wyo., 15-18 May 1999, is shown in our FIG. 11 where the overtrained curve can produce negative values of porosity which are meaningless. Overtraining occurs when a network has learned not only the basic patterns associated with input and output data, but also the subtle nuances and even the noise specific to the training set. If too much training occurs, the network may only memorize the training set and lose its ability to generalize new data. This results in a network that performs well on the training set, but poorly on out-of-sample testing data. Poor predictions can result from an overtrained neural network as discussed in Du, Y., Weiss, W. W., Xu, J., Balch, R. S., and Li, D.: "*Obtain an Optimum Artificial Neural Network Model for Reservoir Studies,*" *SPE Paper* 84445, SPE Annual Technical Conference and Exhibition; Denver, Colo., 5-8 Oct. 2003. Du's work was based on well controlled synthetic datasets with noise added. He evaluated six different functions as synthetic datasets of x to describe y. One example used a value of x as the input and the output, y, where $y=(x^2+1)+\text{random } x$. It was found that 1-34-1 neural network (19 weights) trained to about 100% using 12 to 480 values of y (training records). Ten percent of the values of y (outputs) were parsed for testing purposes. He found that the trained 1-3-4-1 neural network predicted correct values for the parsed values about 100% of the time until the number of training records fell below 32 (a 1.7 records to weights ratio). When the number of training records was decreased to 24 the testing correlation coefficient fell to 72%. This exercise was repeated with 6 different functions including sin(x), sin(x)*cos(x)/2, and three Fourier functions serving as values of y (outputs). In all cases exceeding the weights to records ratio of 2.0 resulted in poor testing performance, identified as "overtraining."

U.S. Pat. No. 6,002,985 to Stephenson discloses a neural network methodology to develop oilfields including well stimulation. FIG. 2 in the '985 patent was generated with data in their Example 1 and shows a very good correlation between predicted production and actual production. The neural network architecture is not disclosed, but 10 input variables were trained with 32 records to generate the cited figure. The 10 input variables were selected manually or with a genetic algorithm. The minimum possible records to weights ratio is a satisfactory 2.9 with a 10-1-1 architecture. If the architecture is 10-2-1 then the ratio is 1.5—resulting in an overtrained solution.

Neither the laboratory wettability altering technique (disclosed in the '894 patent and the '065 patent) nor the artificial intelligence analyses technique (disclosed in the '985 patent) solves the problem of designing field applications of reservoir wettability altering chemicals. Therefore, there is a great need in the art for a method that can effectively utilize this powerful artificial intelligence tool to determine appropriate use of wettability agents.

SUMMARY OF THE INVENTION

A methodology is disclosed to more effectively and efficiently utilize chemicals (surfactants) to alter the wetting of the surface of reservoir rock in a manner that produces additional hydrocarbons for recovery. The method specifically utilizes (1) laboratory tests to select suitable chemicals to promote additional oil recovery beyond the use of water only, (2) a series of field applications conducted utilizing the surfactants determined by the laboratory tests to optimize the amount of surfactant required for additional hydrocarbon recovery, and (3) artificial intelligence (fuzzy logic and neural networks) to analyze and determine the correlation of variables for determining the best surfactant for use and the optimal amount needed for future utilization. The methodology is particularly useful for one or more hydrocarbon producing wells available to place wettability altering chemicals at the surface producing formation.

Particularly, the invention comprises a method for imbibition well stimulation in hydrocarbon recovery which includes performing at least one laboratory test for selection of surfactants; performing at least one original field application to generate a first set of variables; performing at least one second field application applying the surfactants selected by the laboratory tests to generate a second set of variables; ranking the variables; designing artificial intelligence comprising at least one neural network utilizing the ranked variables; and utilizing the at least one neural network to determine predicted change in hydrocarbon recovery with surfactant use.

The method may comprise the following additional steps of determining optimal surfactant type, determining optimal surfactant application level, and/or applying neural network correlation to predict production from additional wells.

Preferably, in the performing at least one laboratory test step, more than one test is performed, and is selected from the group consisting of analyzing for constituents of the reservoir water and hydrocarbon phase, screening wettability altering chemicals, conducting imbibition experiments, conducting flow experiments, and measuring physical properties of the tested core.

The screening of wettability altering chemicals can comprise the step of utilizing capillary tube tests or examining critical micelle concentration.

The conducting of imbibition experiments preferably includes the following steps: saturating at least one reservoir core plug with reservoir water and hydrocarbon and testing imbibition. The testing imbibition step typically comprises the following steps: testing imbibition using water as imbibing fluid; testing imbibition using water plus surfactant as imbibing fluid; and measuring the volume of hydrocarbon for both testing steps.

The physical properties are generally selected from at least one member of the group consisting of saturation, porosity, and permeability. The variables of the first and second set of variables are typically petrophysical variables and production variables, preferably selected from at least one member of the group consisting of thickness of formation, vertical distribution of porosity, permeability, water saturation, lithology, gamma ray, neutron, density, resistivity, photoelectric, diameter of the wellbore, producing pressure, producing rate, and producing volumes. Obtaining a set of original field application test measurements including petrophysical variables from logs and production variables from the production history can be done by utilizing predetermined variables recorded in a petrophysical log and reviewing the production history.

In the step of ranking variables, a fuzzy logic analysis is performed, preferably comprising the following steps: constructing a fuzzy curve for known original value for each petrophysical and production variable; fuzzifying the change in variables obtained from the original and second set of field application tests for at least one of a production rate variable, a production pressure variable, and a production volume measurement variable; determining quantity and volume of surfactant applied; constructing a fuzzy curve of production change versus petrophysical and production variables; and obtaining a range and correlation coefficient for the fuzzy curves.

In the step of designing artificial intelligence, the network is designed by utilizing the top ranked variables as inputs, limited by the available number of outputs to avoid overtraining. In the step of applying the neural network to predict production of additional wells, the required optimal amount of surfactants and/or treatment volume of the surfactants are derived from fuzzy curves constructed from the ranked variables.

The method is easily adapted such that the ranking of variables and the utilization of the at least one neural network can be performed by use of computer software programs.

BRIEF DESCRIPTION OF THE DRAWINGS

The accompanying drawings, which are incorporated into and form a part of the specification, illustrate one or more embodiments of the present invention and, together with the description, serve to explain the principle of the invention. The drawings are only for the purposes of illustration of one or more preferred embodiments of the invention and are not to be construed as limiting the invention in any way.

FIG. 1 is a graph depicting Capillary Pressure (ps) v. Water Saturation (% PV), specifically showing water wet vs. oil wet curves;

FIG. 2 is a drawing generally depicting contact angle measurements in a gas-liquid-solid capillary tube system;

DETAILED DESCRIPTION OF THE INVENTION

Figure 3A:
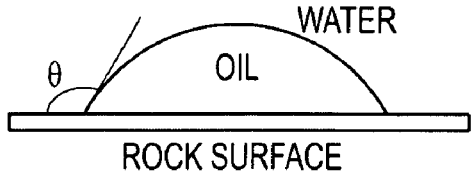
FIG. 3 is a drawing generally depicting contact angle measurements in a water-oil-solid system.
Figure 3B:
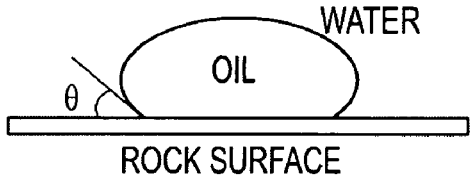
Figure 4:
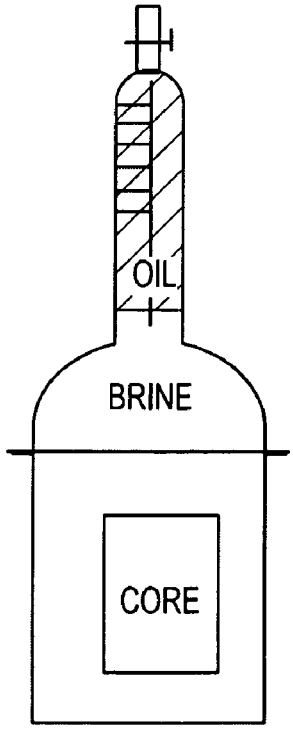
FIG. 4 is a drawing generally depicting the Standness/Austad method for use of surfactants on oil recovery, particularly depicted is an imbibition cell wherein an oil wet core equilibrates in reservoir water, surfactants are then added, and oil recovery is continued.

A methodology is disclosed to more effectively and efficiently utilize chemicals (surfactants) to alter the wetting of the surface of reservoir rock in a manner that produces additional hydrocarbons for recovery. The method specifically utilizes (1) laboratory tests to select suitable chemicals to promote additional oil recovery beyond the use of water only, (2) a series of field applications conducted utilizing the surfactants determined by the laboratory tests to optimize the amount of surfactant required for additional hydrocarbon recovery, and (3) artificial intelligence (fuzzy logic and neural networks) to analyze and determine the correlation of variables for determining the best surfactant for use and the optimal amount needed for future utilization. The methodology is particularly useful for one or more hydrocarbon producing wells available to place wettability altering chemicals at the surface producing formation.

Lab work can easily be performed to determine potential suitability of surfactants, typically by imbibition cell tests.

However, up-scaling lab results to field applications is historically difficult, given the large number of variables involved in field tests. This large number of variables may even so greatly affect the outcome of the field application as to invalidate the lab tests. Field applications in general typically include more than 20 geologic and production variables that could influence the production results. All of these variables may be important, as described herein. However, in many instances, just a few variables are outcome determinative. Therefore, if additional hydrocarbon is to be extracted beyond water imbibement and to the greatest efficiency of recovery, it is critical to determine what variables are outcome determinative and how these variables should be weighted against one another in order to choose an appropriate surfactant and surfactant amount.

Therefore, after performance of one or more typical lab tests (including but not limited to analyzing for constituents of the reservoir water and hydrocarbon phase, screening wettability altering chemicals via capillary tube tests, measuring the critical micelle concentration, and conducting imbibition experiments, all of which are well-known in the art) are performed to determine likely surfactant usage, the variables involved are analyzed in field applications (originally, without surfactant use, and then with surfactant use) to serve as inputs into a neural network for determination of optimum surfactant and optimum surfactant amount. One particularly useful way to obtain the necessary data for the original set of geologic variables is simply to use the petrophysical logs already kept for the wells. The logs typically identify the interpreted values of thickness of the formation, the vertical distribution of porosity, permeability, water saturation, lithology and other properties of the hydrocarbon reservoir known well to the art. The logs can also include the non-interpreted values of gamma ray, neutron, density, resistivity, photoelectric, and spontaneous potential measurements of the formation and the diameter of the wellbore, among other variables. Statistical properties from these logs are used to describe the vertical distributions of the petrophysical log measurements. The production variables describe the producing pressure, rate, and volumes of hydrocarbons and water produced during the producing history of the well. The petrophysical logs are used or field measurements are performed to determine the original set of geologic and production variables.

Once the second set of field applications utilizing surfactant have been performed and the new production variables have been obtained, fuzzy curves developed from the Fuzzy Membership Function can then used to rank the relationship between these experimental variables, (x), (geologic and petrophysical) with the resulting change in the well producing rate, y:

Fuzzy Membership Function, $$F_i(x) = \exp\left(-\left(\frac{x_i - x}{b}\right)^2\right) \cdot y_i,$$

Wherein:

$x=\{x_i\}$;

$i=1, 2, \ldots 99$;

$x_i=0.01*i$;

$y_i$=random ($x_i$); and $$b = \frac{(x_{\max} - x_{\min})}{\sqrt{i}}$$

Thus the change in production from each experimental well is correlated with the well's original geologic and petrophysical data. The results will most likely be determined as changes in the hydrocarbon and water producing rates or the volumes produced over a period of time, however, it is anticipated that other beneficial results could be determined and utilized. Fuzzy curves are then generated by the equation below and used to identify the minimum quantity of chemical required to beneficially change the hydrocarbon and water producing rates.

Fuzzy Curve Function, $$FC(x) = \frac{\sum_{i=1}^{N} F_i(x)}{\sum_{i=1}^{N} F_i(x)/y_i},$$

Wherein:

$F_i(x)$ is the fuzzy membership function;

$x=\{x_i\}$;

$i=1, 2 \ldots 99$;

$x_i=0.01*i$; and $y_i$=random ($x_i$).

For example the variable, y, could be an increase in the oil, water, or gas rate and (x) could be the pounds or barrels of surfactant added to the well per foot of the producing interval.

A neural network is then used to correlate the top ranked variables (as obtained by the Fuzzy Curves) with the results of the field applications. The use of neural network architecture is designed to prevent overtraining as described earlier. The correlation among variables generated from the trained neural network is then used to predict the results of future wettability altering chemical treatments. For example, the log parameters, such as the standard deviations of the gamma ray and neutron logs across the producing formation, could be available for 20 producing wells. These 20 wells are then treated with varying amounts of surfactant on a "pounds per foot of producing formation" basis and the 20 wells then produce varying amounts of incremental oil measured as "barrels per day". From this information, a technician in the art can design a neural network architecture that is trained to sufficiently match the actual incremental oil produced with that predicted by the neural network, taking care to avoid overtraining. Then, using (a) the standard deviations of the gamma ray and neutron logs across the producing formation and (b) the amount of surfactant to be added to an untreated well as input variables, the trained neural network can be used to predict the amount of incremental oil that will result from the treatment.

PREFERRED EMBODIMENT OF THE INVENTIVE METHOD

The preferred method embodiment of the present invention is defined with the following steps below (it is understood that the order of laboratory experiments and the order of field applications may be varied, and that not all experiments/applications must be performed to obtain usable data and, further, that experiments/applications other than those set forth here may provide important data):

1. Laboratory experiments are performed utilizing reservoir core and fluids to select a suitable chemical that alters the wettability of the rock in a manner to produce hydrocarbons (gas and/or liquid) greater than produced by imbibement with water alone. More specifically this can be achieved by one or more elements of the following sub-method:
   a. Analyzing for the constituents of the reservoir water and hydrocarbon phase.
   b. Screening wettability altering chemicals via capillary tube tests, preferably including measurement of the critical micelle concentration.
   c. Conducting imbibition experiments:
      (1) Saturating core plugs (cut from whole reservoir core) with reservoir water and hydrocarbon,
      (2) Testing imbibition using (a) water as imbibing fluid, and (b) water plus chemical as imbibing fluid, and then measuring the volume of hydrocarbon recovered for each.
   d. Conducting flow experiments if hydrocarbon is in the gas phase.
   e. Cleaning the core and measuring physical properties, preferably including, but not limited to saturations, porosity, and permeability.
2. Conducting field applications
   a. Selecting wells, collecting production history to use as original values or measuring the current producing rates if no existing data is available and digitizing available petrophysical logs for calculating statistical log parameters before addition of surfactant.
   b. Designing chemical volumes and concentrations for surfactant use from laboratory work and applying surfactant. (Up-scaling laboratory results to field applications is notoriously difficult, however minimum surfactant concentrations can be estimated and the pounds of surfactant per unit of rock surface can be calculated from laboratory experiments as known in the art: well fracture length can be calculated from field pressure transient tests and the surface area of the fracture can be derived. Thus given the laboratory core surface area and the optimum surfactant concentration the laboratory conditions can be extended to the field. If optimum concentration is not known the use concentration should exceed the CMC.)
   c. Analyzing and defining surfactant use from field application results, includes using, if available, the petrophysical logs, production history and the pounds or volume of surfactant used to correlate with the change in the producing history including, but not limited to changes from initial measurements in producing rate, pressure, and volume.
3. Applying fuzzy logic/neural network analysis by
   a. Constructing a fuzzy curve for each variable.
   b. Fuzzifying change (before and after) in rate, pressure, and volume measurements.
   c. Developing fuzzy curve of production change versus petrophysical and historic production variables.
   d. Recording the range and correlation coefficient from the fuzzy curves.
   e. Ranking variables.
   f. Designing neural network architecture to predict change in hydrocarbon production resulting from wettability alteration. (A destructive architecture development approach can be used where the most complex neural network architecture based on the number of available output records is the starting point. The number of weight being equal to 50% of the number of available records. The complexity of the neural network is then reduced by deleting the number of nodes in the hidden layers and training the network again in an iterative manner until the training correlation drops significantly.)
   g. Applying neural network correlation to predict production from additional wells.
   h. Further evaluating required amount of chemical and volume for future well treatments.

EXAMPLE 1

Laboratory Tests

A core was obtained from the Phosphoria Formation in the Cottonwood Creek Field in the Big Horn Basin of Wyoming. A series of laboratory oil recovery imbibition tests were run on reservoir core plugs. Final imbibition oil recovery was measured with and without surfactant as shown in Table I.

TABLE I

Laboratory Core Imbibition Oil Recovery

| Sample # | Porosity % | Permeability md | Swi % | Recovery Brine, % | Recovery Surfactant, % |
|---|---|---|---|---|---|
| 1 | 17.4 | 3.6 | 0 | 4.1 | 3.2 |
| 2 | 13.7 | 129.4 | 9.6 | 5.9 | 12.6 |
| 3 | 9.5 | 13.1 | 0 | 9.1 | 3.7 |
| 4 | 12.8 | 21.0 | 0 | 0.8 | 5.6 |
| 5 | 12.8 | 3.4 | 0 | 3.5 | 4.4 |
| 6 | 13.0 | 11.1 | 0 | 10.3 | 4.7 |
| 7 | 13.3 | 9.1 | 0 | 10.4 | 1.8 |
| 8 | 13.7 | 12.3 | 23.5 | 2.7 | 5.8 |
| 9 | 16.0 | 22.9 | 7.6 | 6.9 | 4.7 |
| 10 | 9.8 | 5.6 | 0 | 9.2 | 0.8 |
| 11 | 10.6 | 6.4 | 0 | 12.4 | 0.7 |
| 12 | 15.8 | 1.5 | 0 | 3.7 | 1.3 |
| 13 | 7.8 | 0.2 | 0 | 10.6 | 1.2 |
| 14 | 13.0 | 18.9 | 15.3 | 3.1 | 4.7 |
| 15 | 11.4 | 16.8 | 17.8 | 2.5 | 5.8 |
| 16 | 11.5 | 31.3 | 14.4 | 2.2 | 6.2 |
| 17 | 6.4 | 77.9 | 26.3 | 2.9 | 5.7 |
| 18 | 12.1 | 74.2 | 25.9 | 2.4 | 2.6 |

Figure 12:
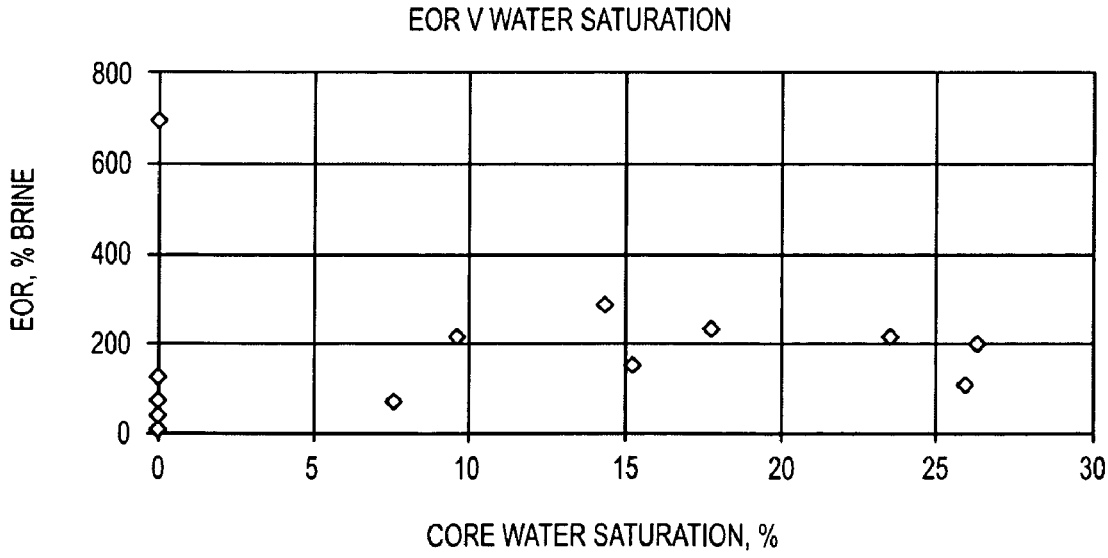
FIG. 12 is a graph depicting oil recovery (EOR, % Primary) as a function of water saturation (% PV)
Figure 13:
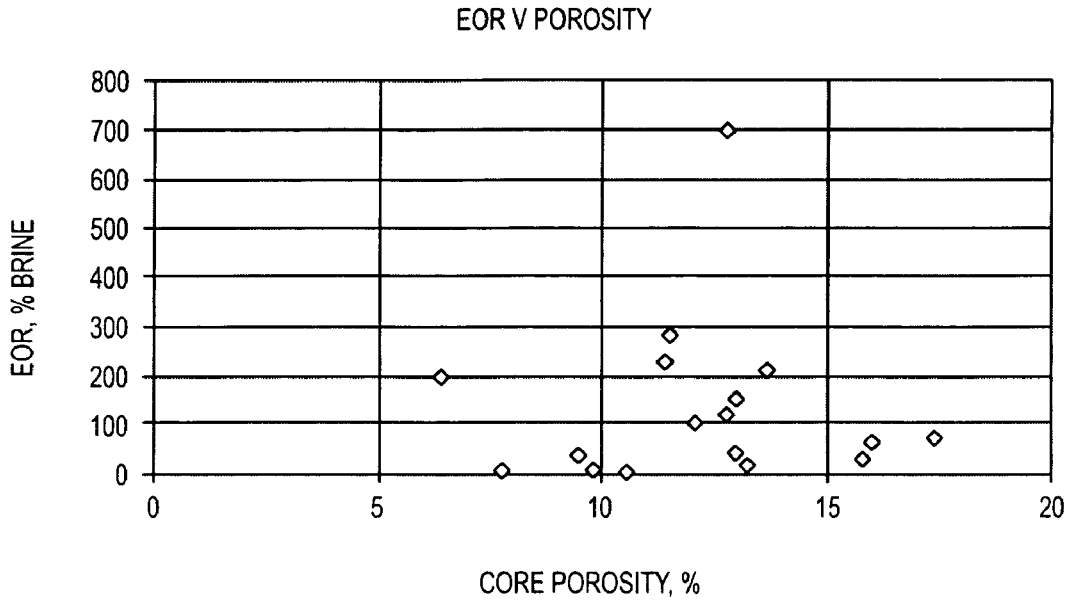
FIG. 13 is a graph depicting oil recovery (EOR, % Primary) as a function of % core porosity.
Figure 14:
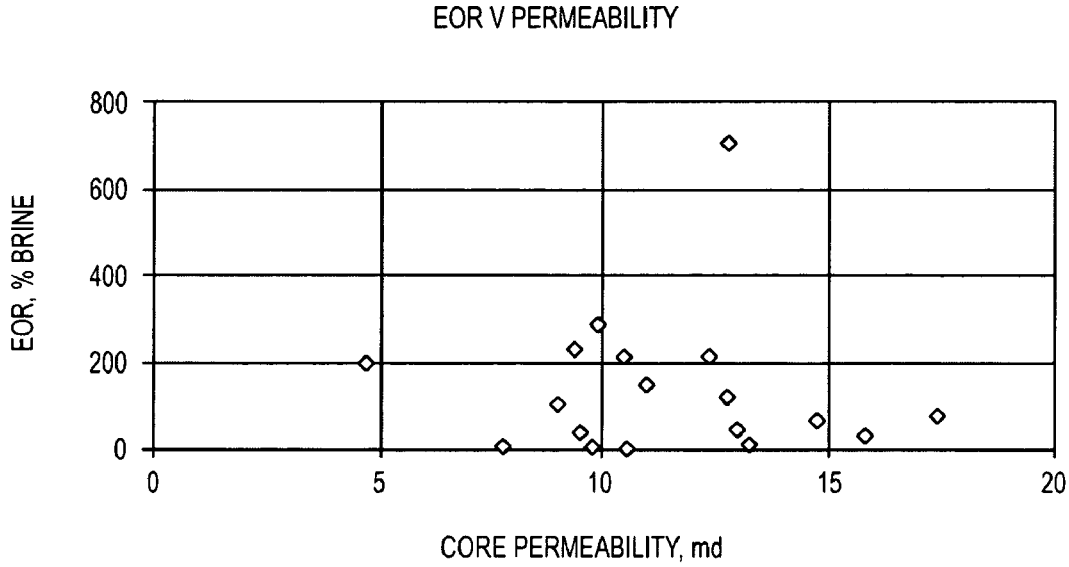
FIG. 14 is a graph depicting oil recovery (EOR, % Primary) as a function of % core porosity.

As shown in FIG. 12, for the cores obtained, the relationship between the product of the core plug porosity and the core plug oil saturation was not clear for a laboratory oil recovery dataset. (The dataset provides an example of fuzzy ranking and overtraining.) Eighteen (18) different core samples were obtained and spontaneous imbibition oil recovery tests were performed with water and a dilute surfactant solution. The variation in the core sample (1) water saturation, (2) porosity, and (3) permeability, served as the experimental variables. The oil recovery results (experimental records) were expressed as a percentage of the increase in surfactant imbibition oil recovery above water imbibition oil recovery. This value is called "Enhanced Oil Recovery as a function of brine recovery" (EOR, % Brine). The EOR records are shown as a function of the three experimental variables as shown in FIGS. 12, 13 and 14.

Figure 15:
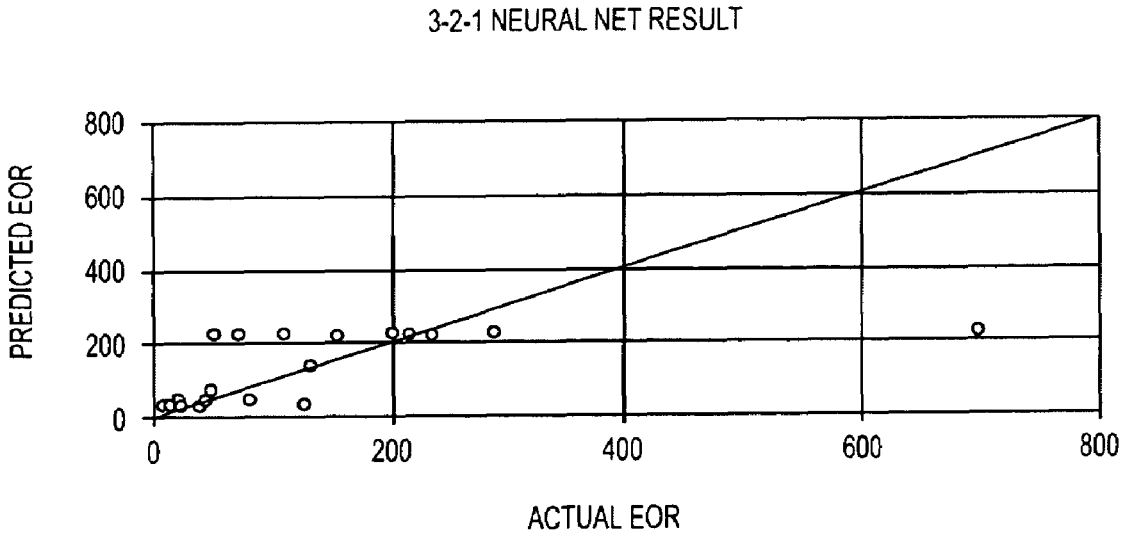
FIG. 15 is a graph depicting neural network training of a 3-2-1 network using poor input variables.
Figure 16:
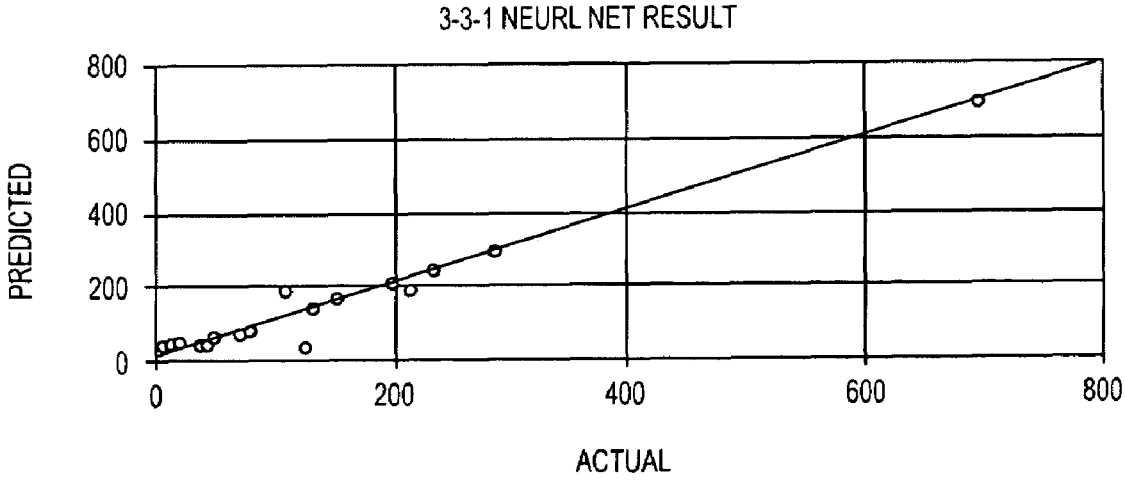
FIG. 16 is a graph depicting neural network training of a 3-3-1 network using poor input variables.

These three variables (saturation, porosity, and permeability) were used as input to a 3-2-1 and a 3-3-1 neural network and the 18 experimental EOR values served as the outputs. The training results are shown in FIGS. 15 and 16 respectively. During the neural network training the weights as defined by the architecture are automatically altered until the network generates predicted values very close to the measured values. The 3-2-1 neural network with 7 weights trained to a 34% correlation coefficient (accuracy), but the 3-3-1 neural network with 12 weights trained to 96% correlation coefficient. Du, Weiss, Balch, and Li indicate that the ratio of records (laboratory test results in this example) to weights should exceed 2 to prevent overtraining. Du, Y., Weiss, W. W., Xu, J., Balch, R. S., and Li, D.: "*Obtain an Optimum Artificial Neural Network Model for Reservoir Studies," Paper SPE* 84445, SPE Annual Technical Conference and Exhibition, Denver, Colo., 5-8 Oct. 2003. The 3-3-1 neural network fails the 2:1 rule while the 3-2-1 neural network exceeds, but only trained to a poor 34%.

Figure 17:
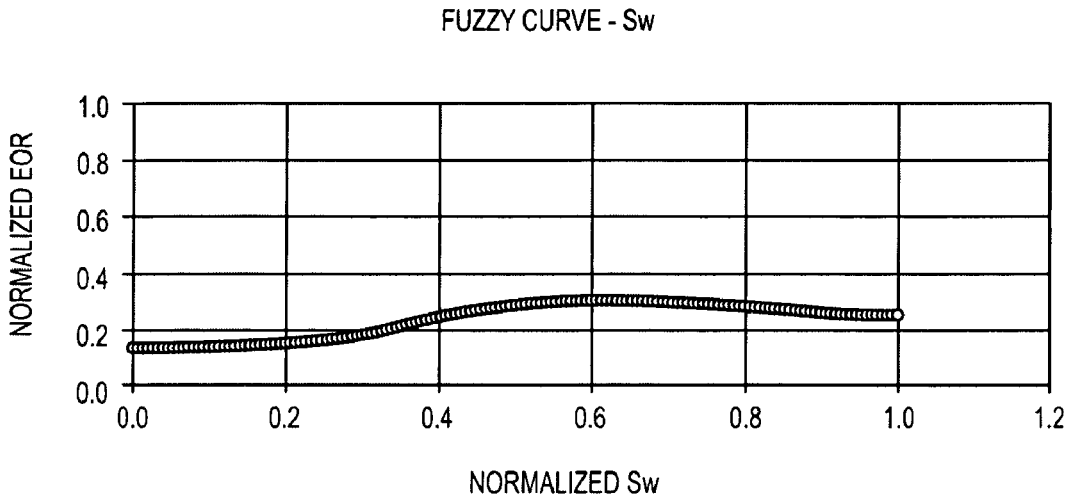
FIG. 17 is a graph predicting water saturation using the poor datasets of FIGS. 12-14.
Figure 18:
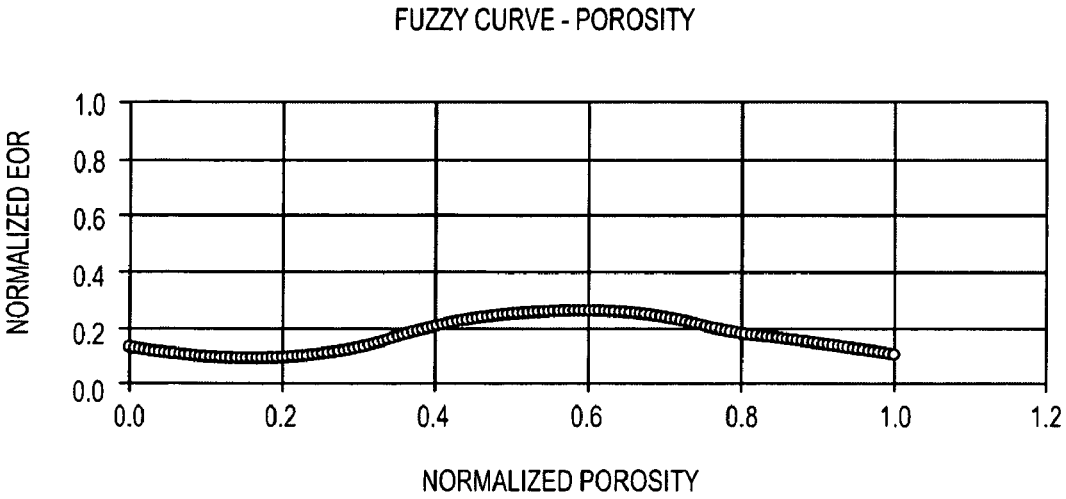
FIG. 18 is a graph predicting core porosity using the poor datasets of FIGS. 12-14.
Figure 19:
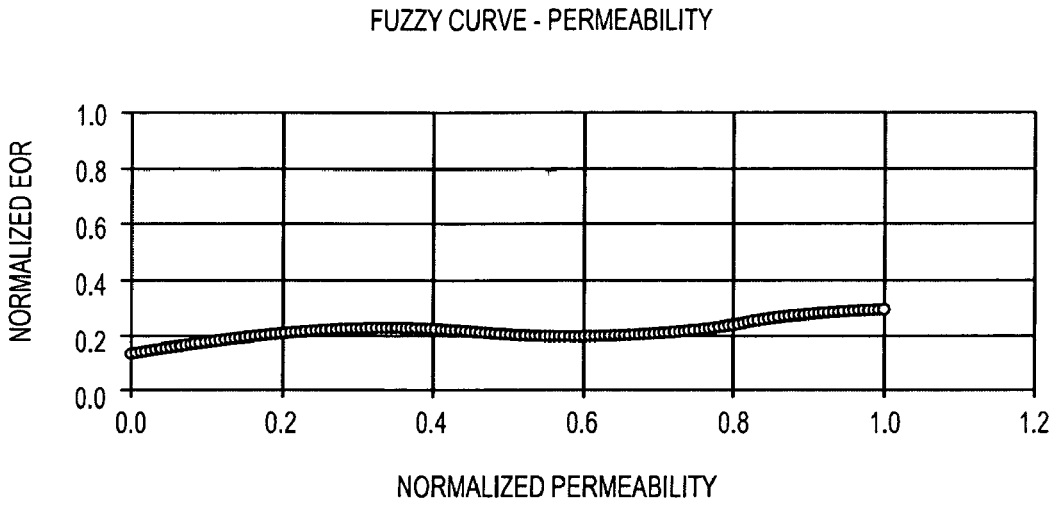
FIG. 19 is a graph predicting core permeability using the poor datasets of FIGS. 12-14.

The fuzzy curves, as shown in FIGS. 17, 18, and 19, support the observation that predictions made with either neural network are dubious. (The fuzzy curves were generated from the datasets illustrated in FIGS. 12, 13, & 14) The three curves were generally flat, indicating that the measured experimental variables did not correlate with the experimental results, since one would expect either an increasing or decreasing trend if the variables did correlate with the results.

Field Application Tests

Figure 5:
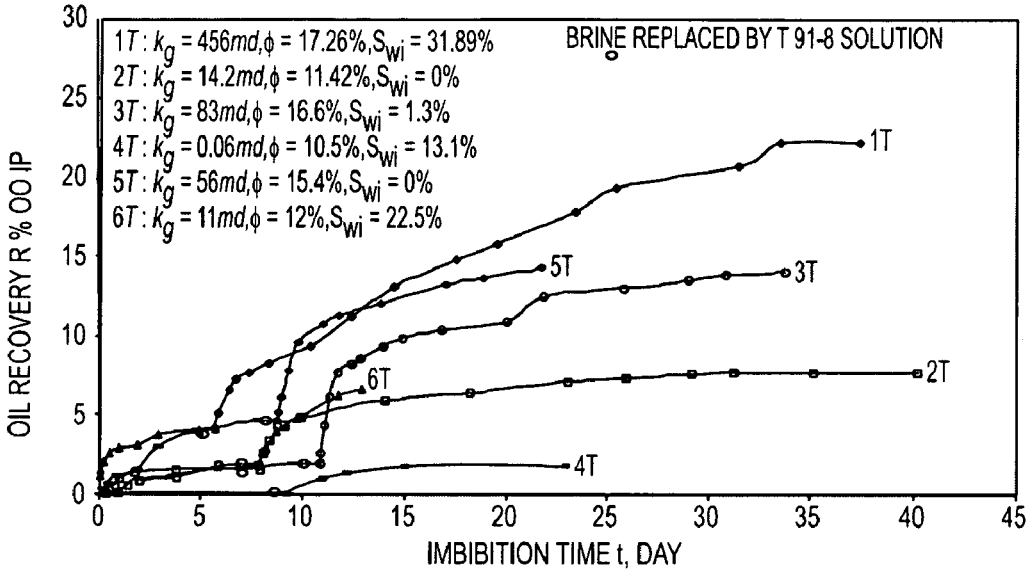
FIG. 5 is a graph depicting oil-water-core system imbibition cell oil recovery results, as EOR (% OOIP) v. Imbibition time (days)
Figure 6:
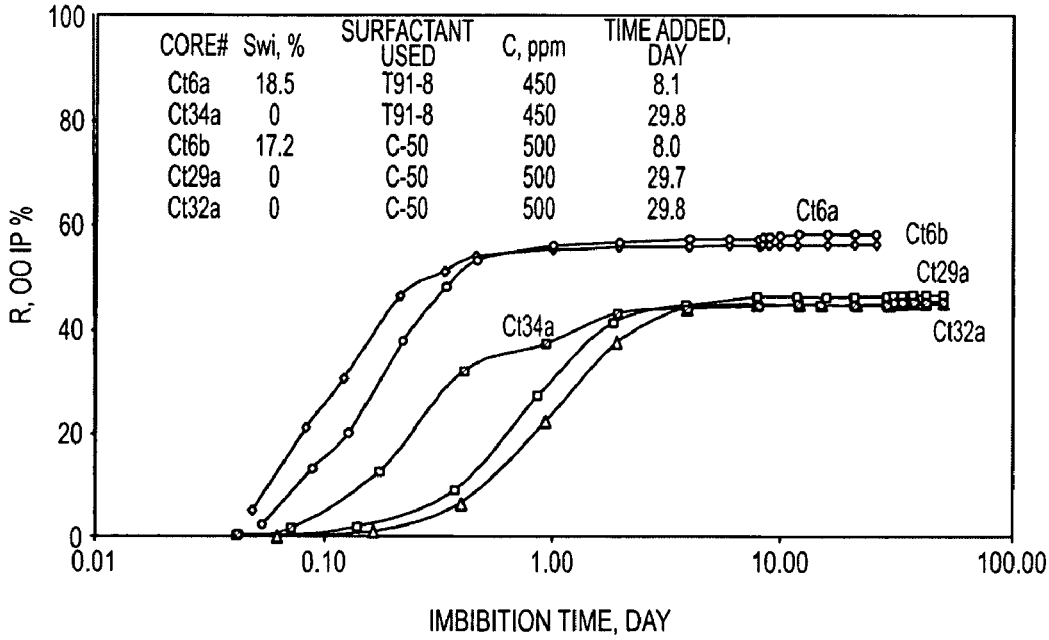
FIG. 6 is a graph depicting oil-water-core system imbibition cell oil recovery, as ROOIP % v. Imbibition time (days), specifically showing very little additional oil produced with the addition of surfactant solution in an oil recovery experiment.
Figure 7:
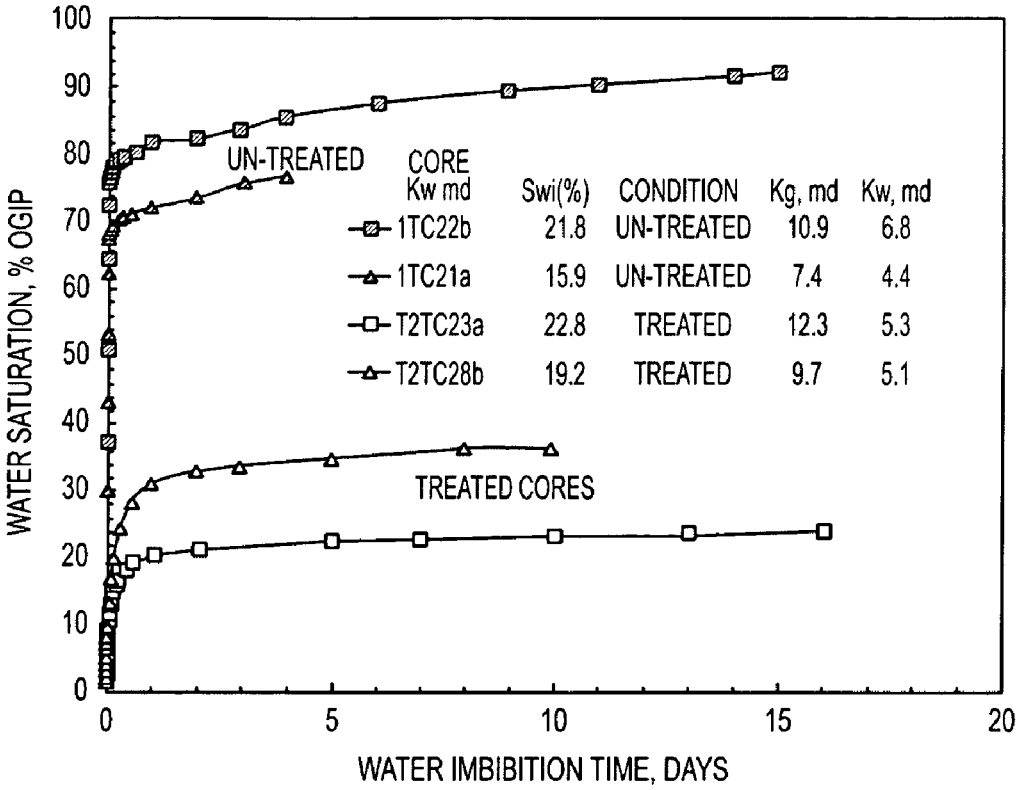
FIG. 7 is a graph depicting gas-water-core system imbibition cell gas recovery (water imbibition, as Water Saturation. % OGIP v. Imbibition time, (days)
Figure 8:
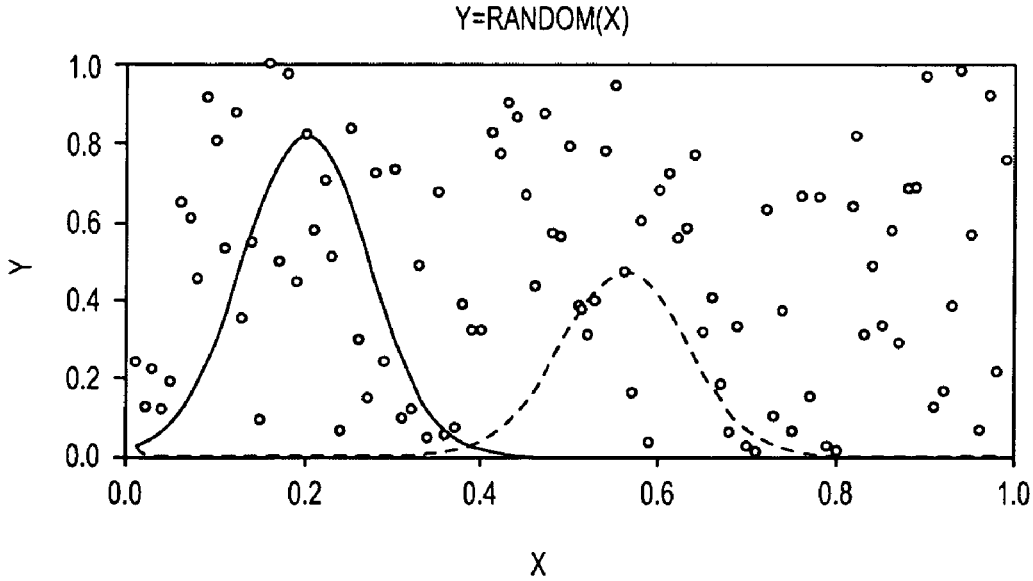
FIG. 8 is a graph of x vs. y depicting a distribution curve for a random dataset with a fuzzy membership function, specifically showing two bell-shaped Gaussian curves and no correlation of the random data.
Figure 9:
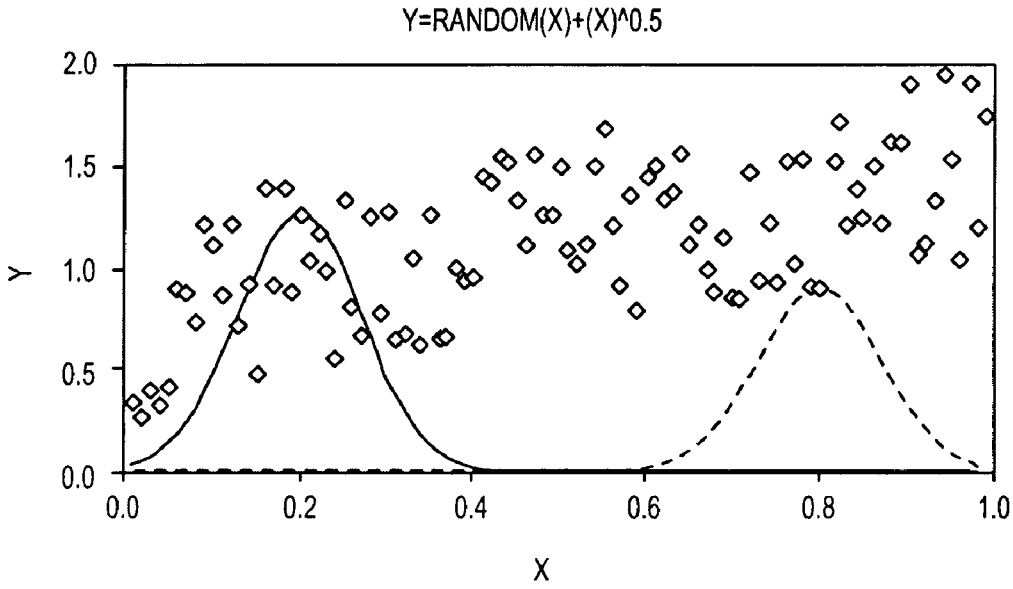
FIG. 9 is a graph of x vs. y utilizing the datasets of FIG. 6, but adding a $x^{0.5}$ trend.
Figure 10:
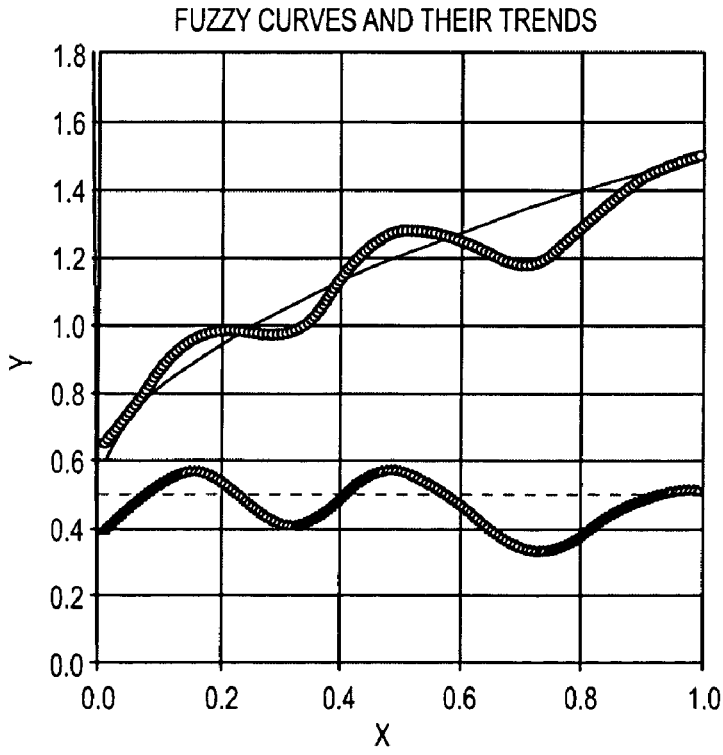
FIG. 10 is a graph of x vs. y, showing fuzzy curves of data with a trend, utilizing fully random data.
Figure 11:
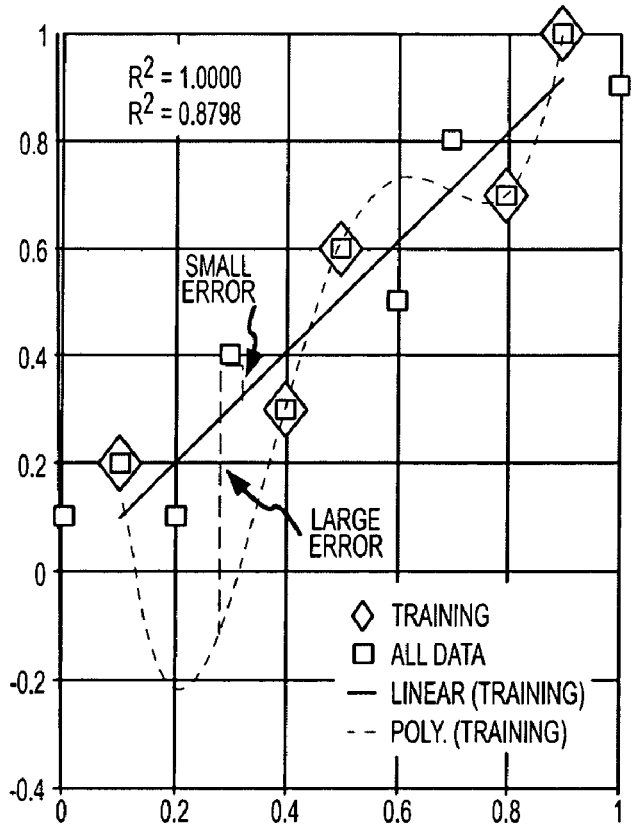
FIG. 11 is a graph depicting overtraining in a neural network, specifically the training curve shows the ability to generate a negative number even though none of the training values were negative.

The laboratory imbibition cell tests (results shown in FIG. 5) were conducted at reservoir temperature with selected reservoir cores and fluids from the dolomite interval in the Phosphoria formation of the Cottonwood Creek field. R. W. Willingham reported that the reservoir used is partially oil wet. Willingham, R. W.: "*The Influence of Geologic Heterogeneities on Secondary Recovery From the Permian Phosphoria Reservoir*: Cottonwood Creek, Wyo.," SPE No. 1770. This was confirmed by the small amount of oil produced from the cores as they imbibed water until the oil recovery rate stabilized in the imbibition cell. After oil recovery stabilized, two series of tests were undertaken. In one the water was replaced with dilute solutions of cationic surfactant, and in the other, nonionic surfactant was used. In all tests the dilute surfactant solution caused more oil to be produced via counter-current imbibition.

All laboratory imbibition tests with surfactant produced incremental oil above that recovered with water alone. Laboratory recovery correlations between EOR and water saturation, porosity, and permeability were poor, plus accurate field values for these parameters are difficult to derive and subject to interpretations so the laboratory results were scaled to field applications based on surface area of core available for surfactant. The formation surface area consists of wellbore surface area plus fracture surface area. The wellbore area, A, was estimated using the formula:

$$A=\pi r^2 l$$

Wherein:
$\pi$=3.214;
r=the wellbore radius; and
l=the length of the producing interval.

Fracture surface area away from the wellbore was estimated from pressure transient tests to obtain fracture length, $l_f$:

$$l_f=r_w e^{-s}$$

Wherein:
$r_w$=the wellbore radius;
e=the logarithmic constant; and
s=the skin factor.

Figure 20:
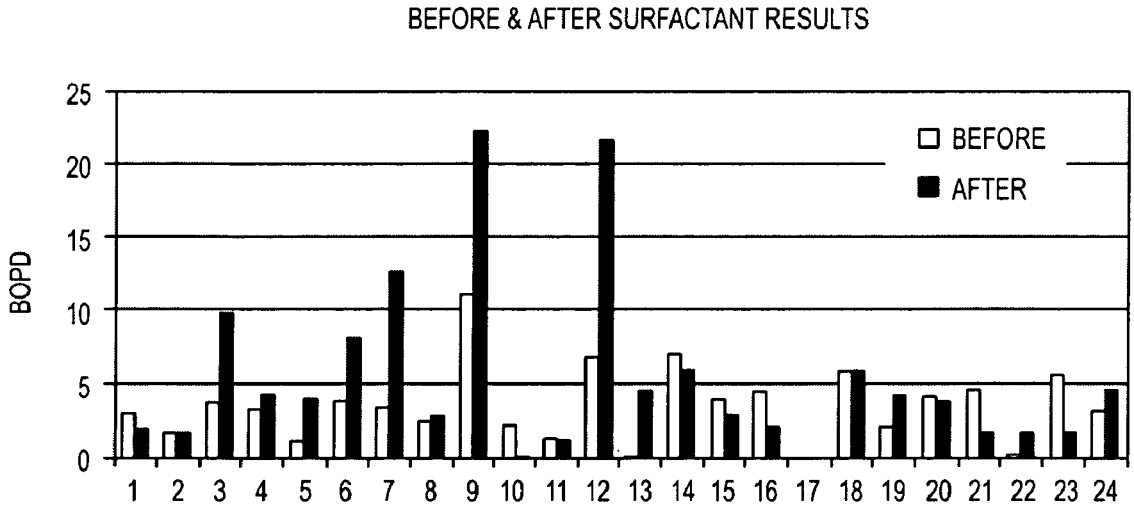
FIG. 20 is a graph demonstrating experimental results of change in oil production rate.
Figure 21:
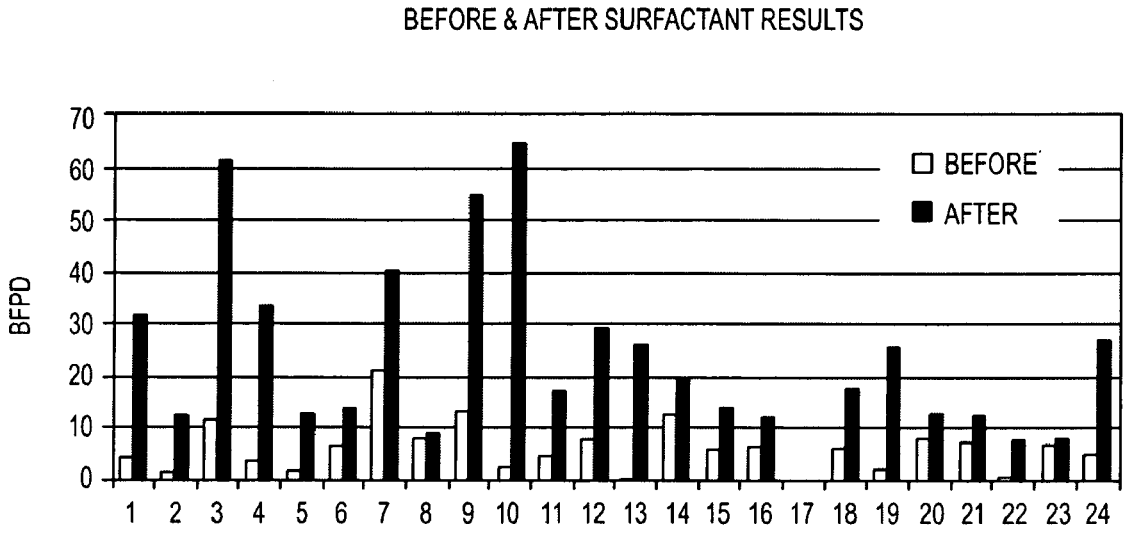
FIG. 21 is a graph demonstrating experimental results of change in total fluid production rate.

Twenty-three wells were then selected to test the laboratory results in the field. The results, expressed as the change in oil production before and after the surfactant addition, are shown in FIG. 20. For completeness, the difference between "before" and "after" total fluid production is shown in FIG. 21. The increase in total fluid production is analogous to an increase in deliverability from a gas reservoir. The 22 ranking variables shown below in Table 2 are thought to possibly be related to the production response. The table arranges the variables by their "fuzzy rank".

TABLE 2

RANKING OF VARIABLES
Oil Rate Increase After Treatment

| Rank No. | Variable | Ranking Parameters $R^2$ | Range | Goodness |
|---|---|---|---|---|
| 1 | Standard Deviation of Gamma Ray | 0.97 | 0.39 | 1.36 |
| 2 | Standard Deviation of BVO Log | 0.85 | 0.52 | 1.36 |
| 3 | Perforations Gross Thickness, ft | 0.80 | 0.54 | 1.34 |
| 4 | Total Fluid Average bbl/d Over Life of Well | 0.95 | 0.27 | 1.22 |
| 5 | Water, bbl/Day | 0.93 | 0.25 | 1.18 |
| 6 | Water Cumulative, bbl | 0.92 | 0.25 | 1.17 |
| 7 | Total Fluid Cumulative, bbl | 0.90 | 0.23 | 1.13 |
| 8 | Oil Cumulative, bbl | 0.89 | 0.15 | 1.04 |
| 9 | Kelly Bushing Elevation, ft | 0.70 | 0.33 | 1.02 |
| 10 | Water Oil Ratio, bbl.bbl | 0.88 | 0.14 | 1.02 |
| 11 | Sum of Gamma Ray | 0.88 | 0.13 | 1.01 |
| 12 | Oil bbl/Day | 0.43 | 0.24 | 0.67 |
| 13 | Average of Neutron Porosity | 0.28 | 0.38 | 0.66 |
| 14 | Total Fluid bbl/Day | 0.56 | 0.09 | 0.66 |
| 15 | Phosphoria Gross Thickness, ft | 0.07 | 0.52 | 0.58 |
| 16 | Phosphoria Bottom Depth, ft | 0.22 | 0.33 | 0.55 |
| 17 | Perforations Bottom Depth, ft | 0.17 | 0.36 | 0.53 |
| 18 | Perforations Top Depth, ft | 0.16 | 0.35 | 0.51 |
| 19 | Phosphoria Top, ft | 0.15 | 0.33 | 0.48 |
| 20 | Sum of Neutron Porosity | 0.23 | 0.23 | 0.47 |
| 21 | Average of Gamma Ray | 0.06 | 0.24 | 0.30 |
| 22 | Standard Deviation of Neutron Porosity | 0.01 | 0.18 | 0.20 |

Figure 22:
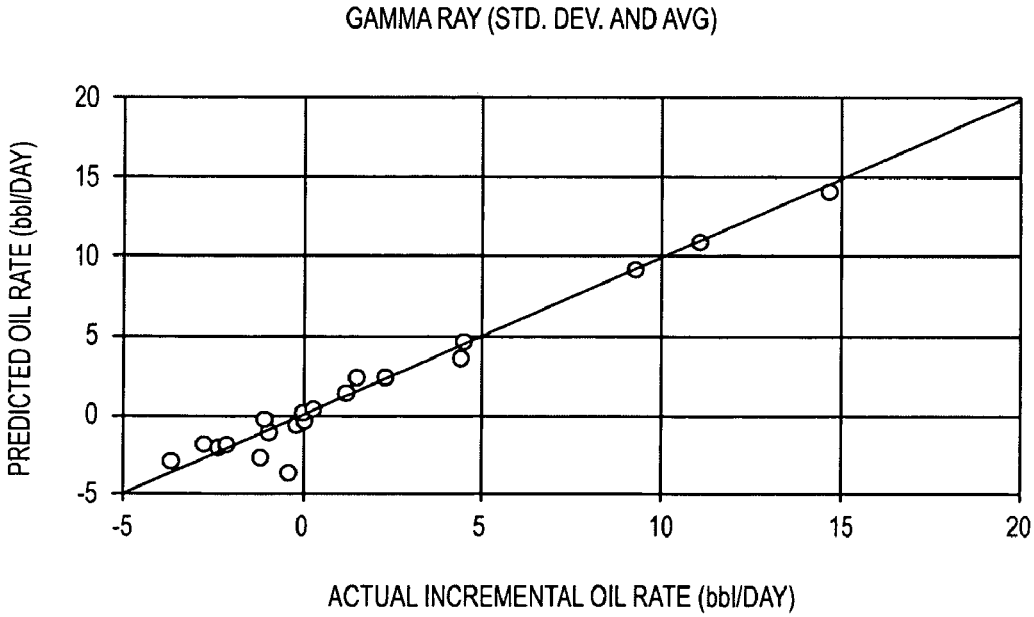
FIG. 22 is a graph depicting the training results of the experimental 2-3-1 architecture neural network and showing no overtraining.

The values in Table 2 were used guide the development of a neural network architecture. Initially, the top ranked variables were used as input, but the complexity of the network was limited by the 2:1 weights:records rule and the 20 available number of treatment results (output records) as inputs to a 2-3-1 neural network to develop an oil increase predictive correlation. A gamma ray is the only universally available log from all wells in the field. Hence the gamma ray statistical parameter of the "average of gamma ray" served as an input despite its low rank. It is probable that the addition of additional variables as inputs would improve the correlations; however oilfield datasets are often sparse and incomplete as demonstrated by this dataset where the logs from three wells were missing. The 2-3-1 training results based on these variables are shown in FIG. 22. The correlations resulting from this trained network can be used to predict the performance of untreated wells given only the gamma ray log.

Figure 23:
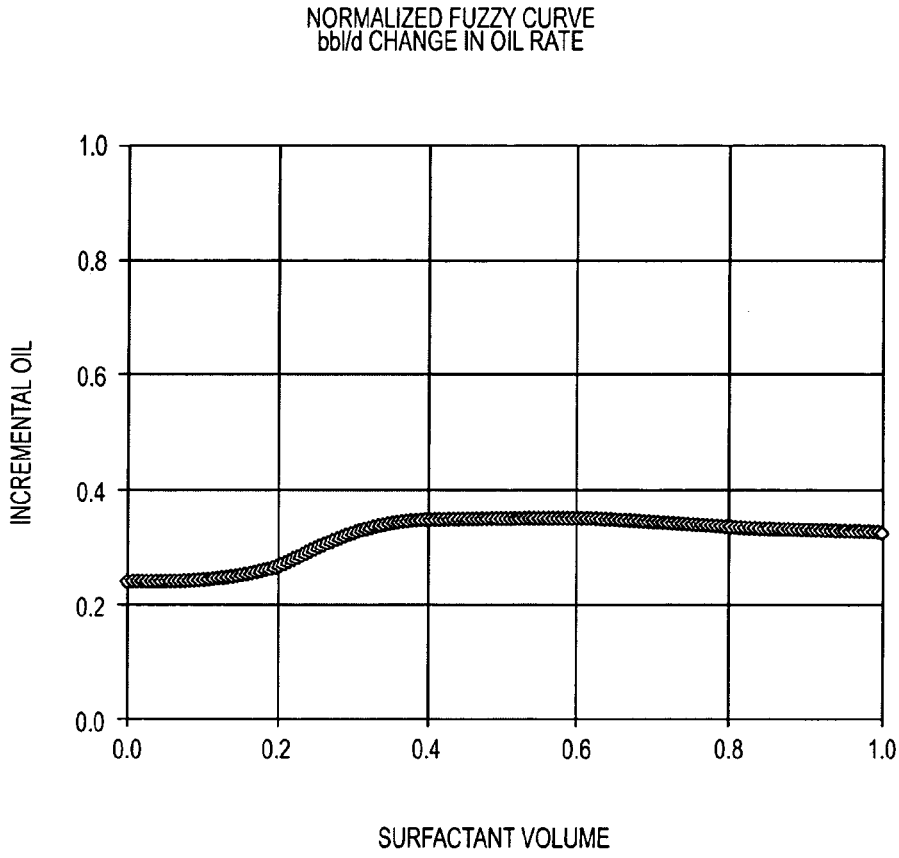
FIG. 23 is a fuzzy curve graph of treatment volume versus incremental oil, showing that normalized treatment volumes can predict the lowest surfactant treatment volume for optimal result.
Figure 24:
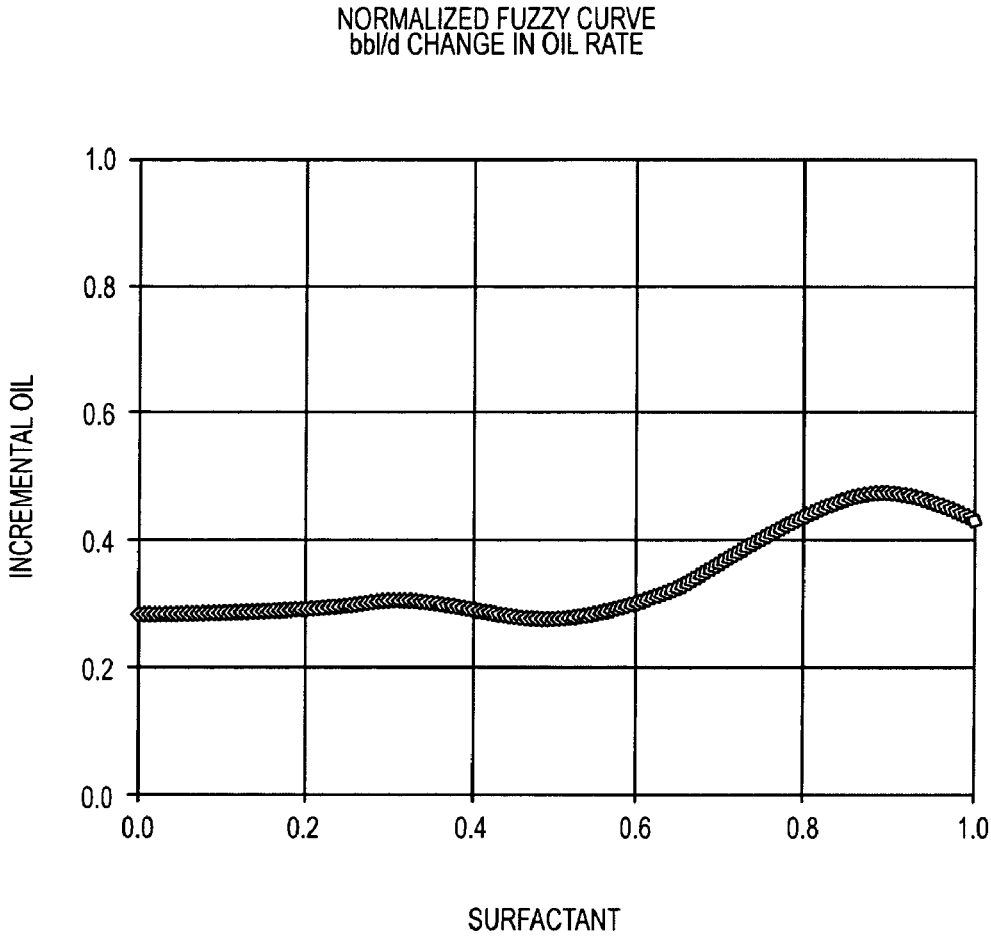
FIG. 24 is a fuzzy curve graph of surfactant amount expressed as maximum-minimum normalized value.

The required amount of chemical and the treatment volume is derived from the fuzzy curves generated from a 20 well dataset. The fuzzy curve may be used to design future treatments. The fuzzy curve of treatment volume versus incremental oil (shown in FIG. 23) indicated that normalized treatment volumes of 500 bbl or 1500 bbl produced approximately the same result. However as shown in FIG. 24, the fuzzy curve of surfactant amount, expressed as a maximum-minimum normalized value, indicated that a normalized minimum of 0.6 or a denormalized value of about 30 lbs/ft was required to obtain favorable results. Therefore, this determined value, 30 lbs./ft can be used to treat the wells and obtain the highest possible output of hydrocarbon with the least amount of surfactant used. As can be seen in the disclosure, the figures, and the examples stated herein, the use of artificial intelligence, particularly fuzzy logic and neural networks provide increased efficiency in utilizing surfactants for imbibement.

What is claimed is:

1. A method for determination of optimal imbibition well stimulation by surfactant use for use in hydrocarbon recovery comprising:

performing at least one laboratory test for selection of surfactants;

performing at least one original field application to generate a first set of variables;

performing at least one second field application applying the surfactants selected by the laboratory tests to generate a second set of variables;

ranking the variables;

designing artificial intelligence comprising at least one neural network utilizing the ranked variables; and utilizing the at least one neural network to determine predicted change in hydrocarbon recovery with surfactant use.

2. The method as in claim 1 comprising an additional step of determining optimal surfactant type.

3. The method as in claim 1 comprising an additional step of determining optimal surfactant application level.

4. The method as in claim 1 comprising an additional step of applying neural network correlation to predict production from additional wells.

5. The method as in claim 1 wherein in the performing at least one laboratory test step, more than one test is performed.

6. The method as in claim 1 wherein the at least one laboratory test is selected from the group consisting of analyzing for constituents of the reservoir water and hydrocarbon phase, screening wettability altering chemicals, conducting imbibition experiments, conducting flow experiments, and measuring physical properties of a tested core.

7. The method as in claim 6 wherein the screening of wettability altering chemicals comprises a step of utilizing capillary tube tests.

8. The method as in claim 6 wherein the screening of wettability altering chemicals comprises a step of examining critical micelle concentration.

9. The method as in claim 6 wherein the conducting of imbibition experiments comprises the following steps:

saturating at least one reservoir core plug with reservoir water and hydrocarbon; and testing imbibition.

10. The method as in claim 9 wherein the testing imbibition step comprises the following steps:

testing imbibition using water as imbibing fluid;

testing imbibition using water plus surfactant as imbibing fluid; and measuring the volume of hydrocarbon for both testing steps.

11. The method as in claim 6 wherein the physical properties the properties are selected from at least one member of the group consisting of saturation, porosity, and permeability.

12. The method as in claim 1 wherein the first and second set of variables are petrophysical variables and production variables.

13. The method as in claim 12 wherein the petrophysical variables and production variables are selected from at least one member of the group consisting of thickness of formation, vertical distribution of porosity, permeability, water saturation, lithology, gamma ray, neutron, density, resistivity, photoelectric, diameter of the wellbore, producing pressure, producing rate, and producing volumes.

14. The method as in claim 12 wherein the step of obtaining a at least one set of original field application to generate a first set of petrophysical variables and production variables comprises utilizing pre-determined variables recorded in a petrophysical log.

15. The method as in claim 1 wherein in the step of ranking variables, a fuzzy logic analysis is performed.

16. The method as in claim 15 wherein the fuzzy logic analysis comprises the following steps:

constructing a fuzzy curve for known original value for each petrophysical and production variable;

fuzzifying a change in variables obtained from the original and second set of field application tests for at least one of a production rate variable, a production pressure variable, and a production volume measurement variable;

constructing a fuzzy curve of production change versus petrophysical and production variables; and obtaining a range and correlation coefficient for the fuzzy curves.

17. The method as in claim 1 wherein in the step of designing artificial intelligence, the network is designed by utilizing the top ranked variables as inputs, limited by the available number of outputs to avoid overtraining.

18. The method as in claim 4 wherein in the step of applying the neural network to predict production of additional wells, the required optimal amount of surfactants and/or treatment volume of the surfactants are derived from fuzzy curves constructed from the ranked variables.

19. The method as in claim 1 wherein the ranking of variables is performed by use of computer software programs.

20. The method as in claim 1 wherein the utilization of the at least one neural network comprises use of computer software programs.

* * * * *